US005137153A

United States Patent [19]

Hendriks

[11] Patent Number: 5,137,153

[45] Date of Patent: Aug. 11, 1992

[54] PACKAGE OF STRANDS WITH A HEXAGONAL-LIKE CROSS SECTION

[75] Inventor: Ivo G. Hendriks, Overpelt, Belgium

[73] Assignee: Teepak, Inc., Westchester, Ill.

[21] Appl. No.: 696,436

[22] Filed: May 6, 1991

[51] Int. Cl.[5] ..... B65D 85/20

[52] U.S. Cl. ..... 206/443; 206/802; 53/447

[58] Field of Search ..... 206/443, 802, 499; 53/444, 447, 412

[56] References Cited

U.S. PATENT DOCUMENTS

| | | | |
|---|---|---|---|
| 1,458,236 | 6/1923 | Morey et al. | 206/443 |
| 2,730,259 | 1/1956 | Frick | 206/443 |
| 3,206,020 | 9/1965 | Billingsley | 206/443 |
| 3,220,583 | 11/1965 | Robertson | 206/443 |
| 3,471,305 | 10/1969 | Marbach | 206/802 |
| 3,616,989 | 11/1971 | Martinek et al. | 229/32 |
| 3,764,351 | 10/1973 | Whittington et al. | 206/802 |
| 3,971,187 | 7/1976 | McNeill et al. | 206/802 |
| 4,295,563 | 10/1981 | Becker et al. | 206/802 |

FOREIGN PATENT DOCUMENTS

| | | | |
|---|---|---|---|
| 191195 | 6/1937 | Switzerland | 206/443 |

*Primary Examiner*—Paul T. Sewell
*Assistant Examiner*—Thomas P. Hilliard
*Attorney, Agent, or Firm*—Michael L. Dunn; Robert P. Simpson

[57] ABSTRACT

The invention comprises a package comprising 50 shirred essentially cylindrically shaped shirred food casing strands. The strands are oriented in the package such that longitudinal axes of the strands are parallel. Within the package external surfaces of the strands contact external surfaces of adjacent strands and ends of the strands terminate in approximately the same plane. In a plane perpendicular to the longitudinal axes of the strands, lines passing through the central axes of strands located proximate the external surface of the package intersect to form a hexagon. Strands internally within the package, i.e., which would not have an exteriorly exposed surface if a wrap for the package were removed, contact six adjacent strands. The package consists of nine strand rows. The first row contains four strands. The second row contains five strands. The third row contains six strands and the fourth row contains seven strands. The fifth row is the center row and contains six strands. The sixth row contains seven strands. The seventh row contains six strands. The eighth row contains five strands and the ninth row contains four strands. The package has a retaining means, usually a package wrap, for securing the strands within the package in the previously described orientation.

6 Claims, 3 Drawing Sheets

PACKAGE OF STRANDS WITH A HEXAGONAL-LIKE CROSS SECTION

BACKGROUND OF THE INVENTION

This invention relates to packaging for shirred food casing strands. Food casings are used for packaging food products, especially meats such as sausages, but also for other food products, such as cheeses. When delivered to a meat packer, such strands are commonly in shirred form, i.e., folded in the form of a cylindrical strand, usually containing from 50 to 125 units of length of unshirred casing per unit length of shirred strand. When such casings are shirred, they are packaged for delivery to the meat packer, to protect the strand from contamination, accidental deshirring (unfolding), crushing, or strand breakage (i.e., breaking or deshirring of the strand between the ends of the strand such that the strand looses coherency and is no longer self supporting in folded form).

Several problems are encountered in prior art strand packaging. For example, such packaging tends not to pack the strands in the most space efficient organization; the strands tend to need significant external support; and protection, e.g., in the form of corrugated boxes; the strands do not protect each other from damage in the package as well as desired; the packages are often cumbersome to handle and empty, which often resulted in disorganized or damaged strands after removal, especially when being used on automatic machines; the cost of packaging has been higher than desired due to package strength requirements; and easily manageable numbers, e.g., 50 strands per package, were difficult to obtain in a space efficient package.

BRIEF DESCRIPTION OF THE INVENTION

In accordance with the present invention, there is therefore provided a space efficient strand package which effectively protects the strands during transfer from larger containers, holding such packages, to casing stuffing apparatus; which package needs significantly reduced strength requirements and is therefore less costly; which is easy to handle; from which strands are easily removed without damage while maintaining good alignment of the strands with each other along their longitudinal axes; and which contain 50 strands each.

More particularly, the invention comprises a package comprising 50 shirred, essentially cylindrically shaped, shirred food casing strands. The strands are oriented in the package such that longitudinal axes of the strands are parallel. Within the package, external surfaces of the strands contact external surfaces of adjacent strands and ends of the strands terminate in approximately the same plane. In a plane perpendicular to the longitudinal axes of the strands, lines, passing through the central axes of strands located proximate the external surface of the package, intersect to form a hexagon. Strands internally within the package, i.e., which would not have an exteriorly exposed surface if a wrap for the package were removed, contact six adjacent strands. The package consists of nine strand rows. The first row contains four strands. The second row contains five strands. The third row contains six strands and the fourth row contains seven strands. The fifth row is the center row and contains six strands. The sixth row contains seven strands. The seventh row contains six strands. The eighth row contains five strands and the ninth row contains four strands. The package has a retaining means, usually a package wrap, for securing the strands within the package in the previously described orientation.

DETAILED DESCRIPTION OF THE INVENTION

Figure 1:
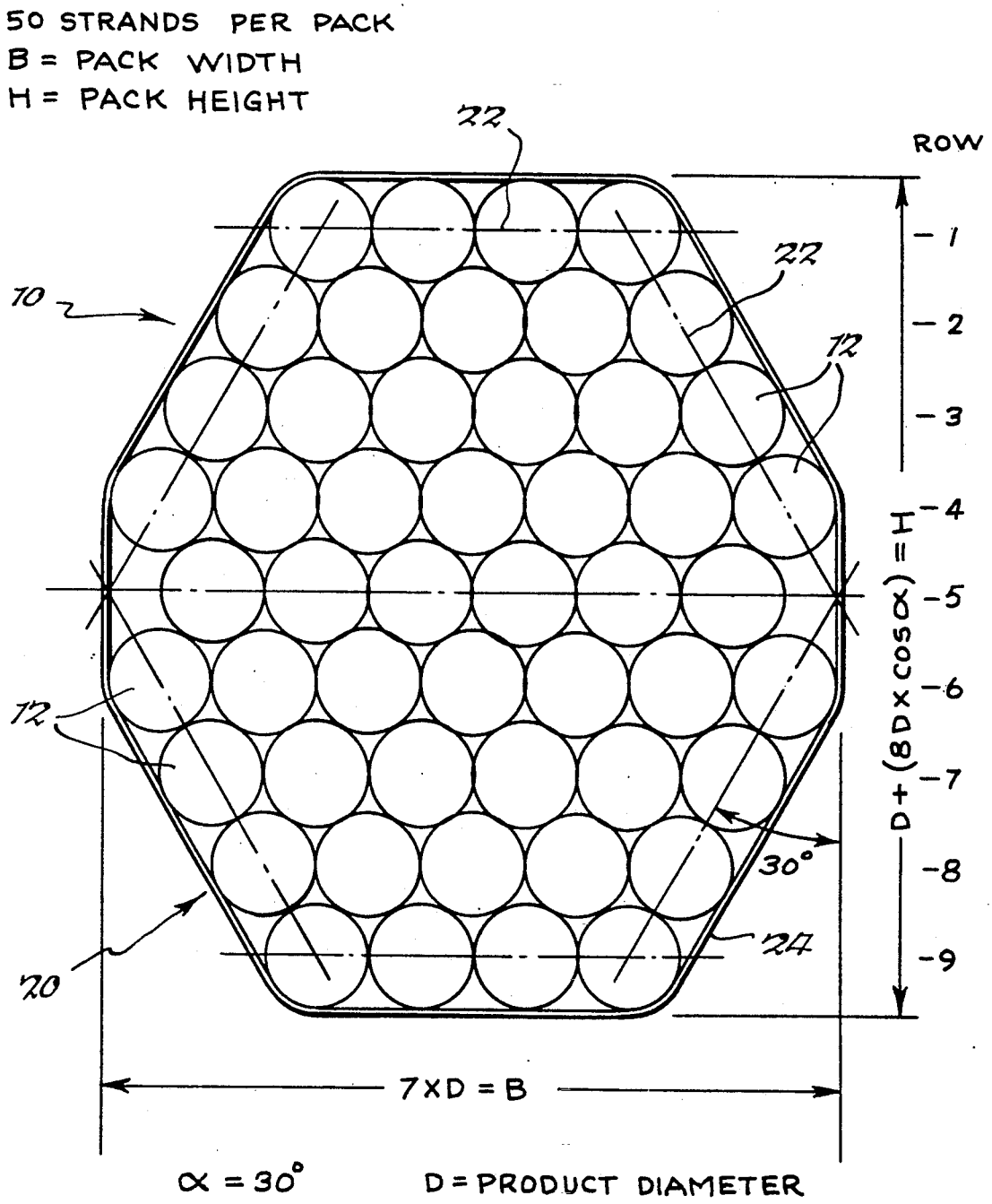
FIG. 1 shows an end view of the package of the invention.
Figure 2:
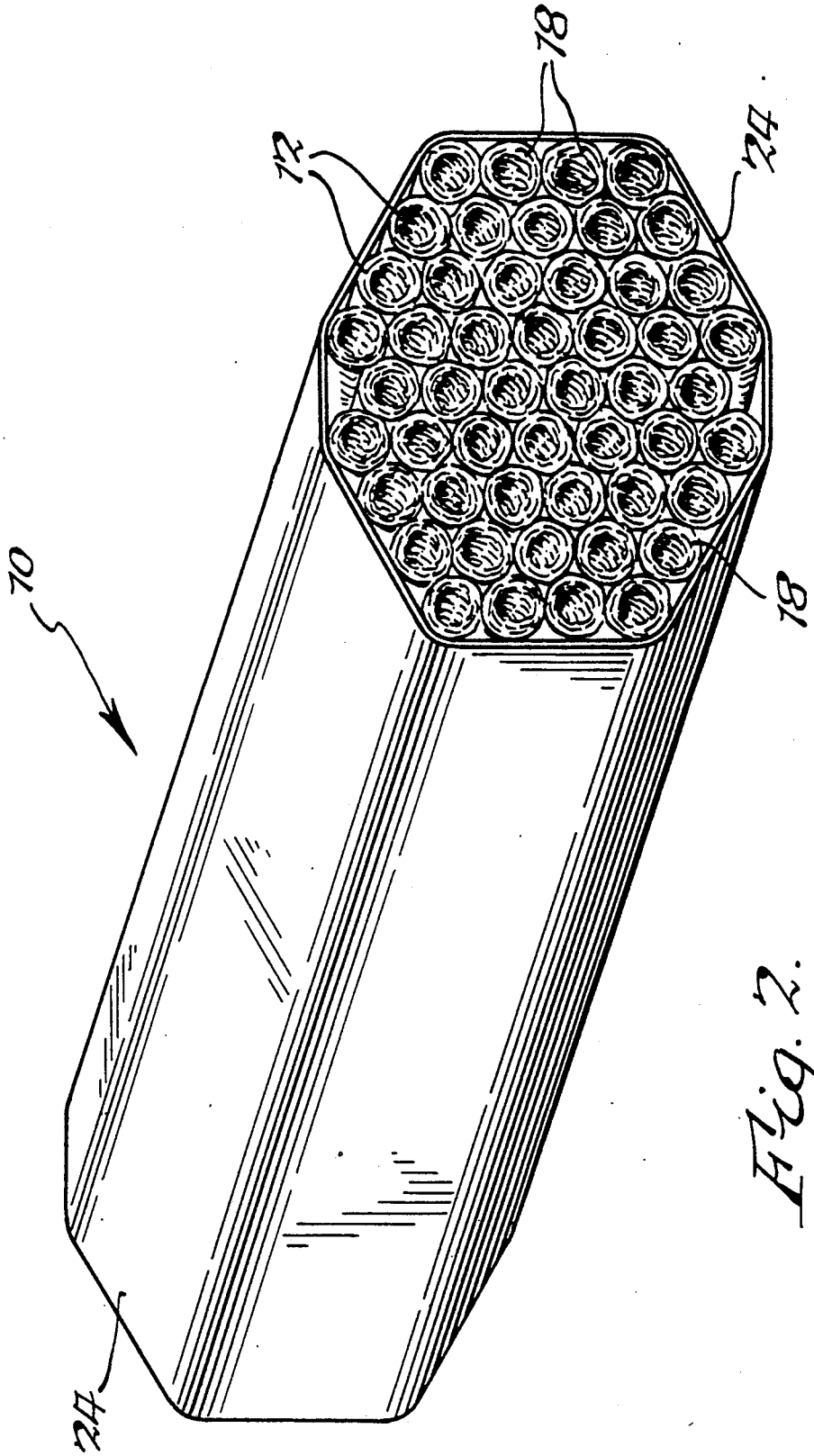
FIG. 2 shows the same package as FIG. 1 in a perspective view.
Figure 3:
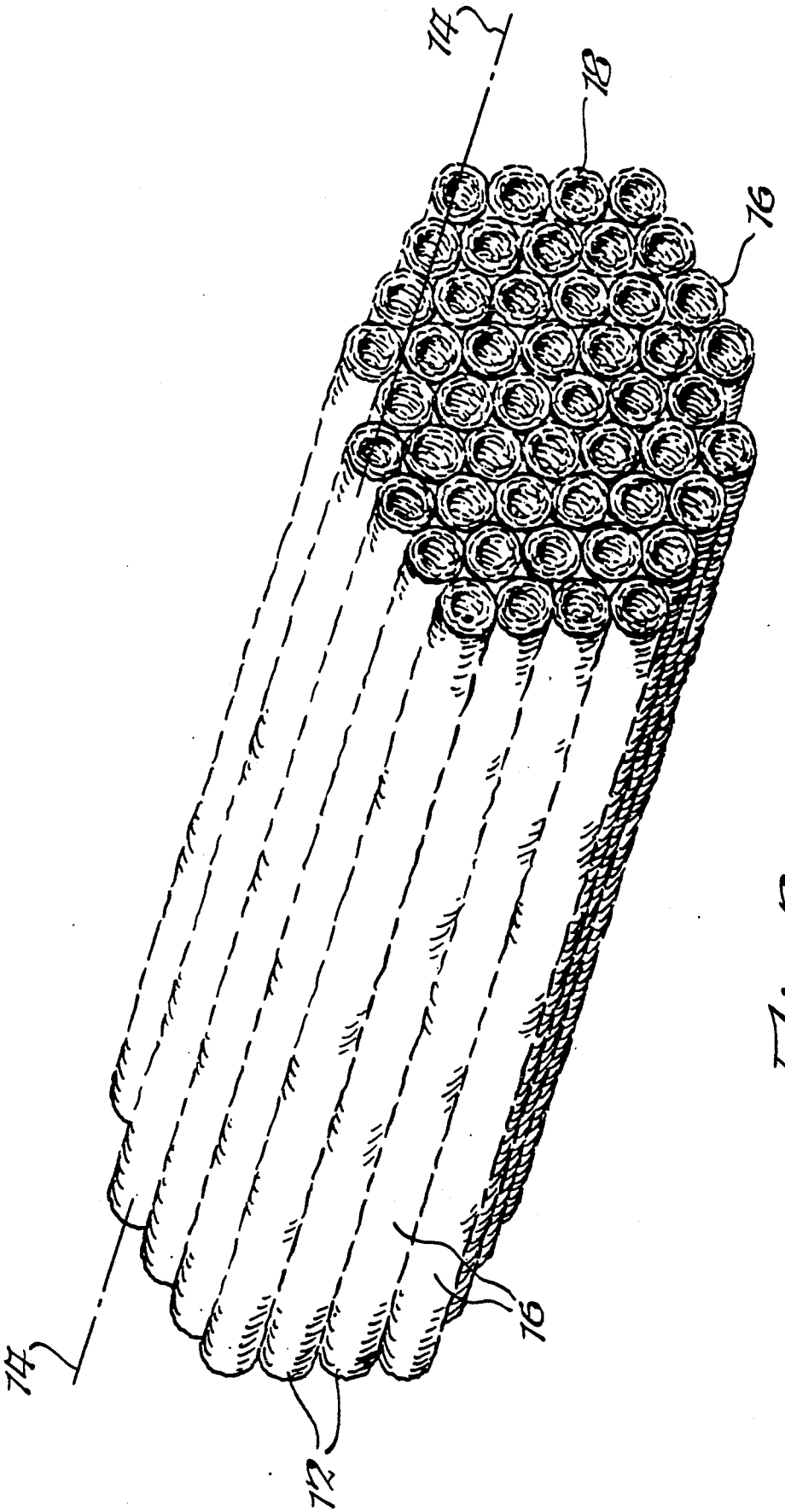
FIG. 3 is the perspective view of FIG. 2 with the wrap removed.

As shown in FIGS. 1–3 which illustrate a preferred embodiment of the invention, a package 10 is provided which comprises 50 strands 12, of a shirred casing product which is most commonly used to package food, e.g., sausages in the form of hot dogs, salami, bologna, etc. Such casings are also commonly used to package lunch meats such as composite pressed ham and products such as cheeses. By shirred strand is meant a tubular casing product which has been folded or pleated in such a way that it has been compressed along its longitudinal axis to from one fiftieth (1/50) to one two hundredth (1/200) of its unshirred length and usually to one sixtieth (1/60) to one one hundred twenty fifth (1/125) of its unshirred length.

The shirred casing strands may be of any food casing material, e.g., regenerated cellulose, collagen, or fibrous, i.e., regenerated cellulose impregnated paper. As can be seen in the figures, the shirred food casing strands 12, are essentially cylindrical in shape and are oriented in the package 10 such that longitudinal axes 14 of the strands 12 are parallel within the package. External surfaces 16 of the strands contact external surfaces of adjacent strands and when a strand is entirely embedded within the casing, the external surface of the strand contacts six adjacent strands in a stable space efficient configuration. Ends 18 of the strands terminate in a plane 20 perpendicular to the longitudinal axes 14 of strands 12. Such a plane may be considered as represented by FIG. 1.

As seen in FIG. 1, lines 22 passing through the longitudinal axes of strands 12 intersect to form a hexagon. The package width B, as shown in FIG. 1 may be represented by seven times the diameter of the strands and package height H may be represented by the formula.

$$H=D+(8D\times\cos\alpha)$$

where, as shown in FIG. 1, $\alpha=30°$, H=height and D=the strand diameter.

As seen in the drawings, especially FIG. 1, the strands within the package are organized into nine strand rows. The first and ninth rows contain four strands, the second and eighth rows contain five strands, the third and seventh rows contain six strands, the fourth and sixth rows contain seven strands and the fifth row, also being the center row, contains six strands.

The package, as seen in FIGS. 1 and 2 has an external retaining means 24 which provides radial pressure to hold the strand package together. The retaining means is usually a wrap of paper or plastic film which simultaneously provides protection for the strands, but may also be another form of retaining means, such as a net or bands.

The ends of the package may optionally be sealed to provide moisture retention and the strand packages may be further packaged in a carton or other container in quantities of one or more. Two packages to a carton would, for example, provide 100 strands to a carton.

As can be readily seen, the strand package of the invention provides efficient packing of strands; is very stable, provides strand protection; utilizes very little packaging material in addition to the strands themselves; can be readily opened simply by removing the retaining means which allows removal from the package, for example within the hopper of an automated casing filling machine; yet, the cost of the package is relatively low when compared with previous packaging methods for shirred casing strands.

What is claimed is:

1. A package comprising 50 shirred essentially cylindrically shaped food casing strands, said strands being oriented in such package such that longitudinal axes of the strands are parallel; external surfaces of the strands contact external surfaces of adjacent strands; ends of the strands terminate in approximately the same plane; in a plane perpendicular to the longitudinal axes of the strands, lines passing through the central axes of strands located proximate the external surface of the package intersect to form a hexagon; and strands internally within the package contact six adjacent strands; said package consisting of nine strand rows, the first row containing four strands, the second row containing five strands, the third row containing six strands, the fourth row containing seven strands, the fifth row containing six strands and being a center row, the sixth row containing seven strands, the seventh row containing six strands, the eighth row containing five strands and the ninth row containing four strands; said package having a surrounding retaining means for securing the strands in such orientation.

2. The package of claim 1, wherein the retaining means is a plastic film.

3. The package of claim 1, wherein the strands are shirred regenerated cellulose strands.

4. The package of claim 1, wherein the strands are shirred collagen strands.

5. The package of claim 1, wherein the strands are shirred fibrous strands.

6. A method for loading a food casing filling machine having a shirred food casing strand hopper which comprises loading the hopper with a strand package which comprises:

50 shirred essentially cylindrically shaped food casing strands, said strands being oriented in such package such that longitudinal axes of the strands are parallel; external surfaces of the strands contact external surfaces of adjacent strands; ends of the strands terminate in approximately the same plane; in a plane perpendicular to the longitudinal axes of the strands, lines passing through the central axes of strands located proximate the external surface of the package intersect to form a hexagon; and strands internally within the package contact six adjacent strands; said package consisting of nine strand rows, the first row containing four strands, the second row containing five strands, the third row containing six strands, the fourth row containing seven strands, the fifth row containing six strands and being a center row, the sixth row containing seven strands, the seventh row containing six strands, the eighth row containing five strands and the ninth row containing four strands; said package having a surrounding retaining means for securing the strands in such orientation, and removing the surrounding retaining means.

* * * * *